United States Patent [19]

Ayer

[11] Patent Number: 4,852,252

[45] Date of Patent: Aug. 1, 1989

[54] METHOD OF TERMINATING WIRES TO TERMINALS

[75] Inventor: Kenneth N. Ayer, Hummelstown, Pa.

[73] Assignee: AMP Incorporated, Harrisburg, Pa.

[21] Appl. No.: 277,094

[22] Filed: Nov. 29, 1988

[51] Int. Cl.[4] ..... H01R 43/02

[52] U.S. Cl. ..... 29/860; 29/447; 174/DIG. 8; 174/84 R; 174/88 C; 264/230

[58] Field of Search ..... 174/DIG. 8, 88 R, 84 R, 174/35 C, 36, 88 C; 29/860, 857, 447; 264/230

[56] References Cited

U.S. PATENT DOCUMENTS

| | | | |
|---|---|---|---|
| 3,360,631 | 12/1967 | Hess | 29/447 X |
| 3,396,460 | 8/1968 | Westmore | 264/230 X |
| 3,525,799 | 8/1970 | Ellis et al. . | |
| 3,601,783 | 8/1971 | Loose . | |
| 3,708,611 | 1/1973 | Dinger . | |
| 3,721,749 | 3/1973 | Clabburn | 174/DIG. 8 X |
| 3,945,114 | 3/1976 | Siden et al. . | |
| 4,256,945 | 3/1981 | Carter et al. . | |
| 4,292,099 | 9/1981 | Dinger . | |
| 4,341,921 | 7/1982 | Simpson . | |
| 4,436,565 | 3/1984 | Weitzel et al. | 174/88 C X |
| 4,460,820 | 7/1984 | Matsumoto et al. | 264/230 X |
| 4,464,540 | 8/1984 | Reeber | 174/DIG. 8 X |
| 4,504,699 | 3/1985 | Dones et al. | 174/DIG. 8 X |
| 4,595,724 | 6/1986 | Koblitz . | |
| 4,623,401 | 11/1986 | Derbyshire et al. . | |
| 4,626,767 | 12/1986 | Clappier et al. . | |
| 4,659,912 | 4/1987 | Derbyshire . | |
| 4,695,713 | 9/1987 | Krumme . | |
| 4,696,841 | 9/1987 | Vidakovits | 174/DIG. 8 X |
| 4,701,587 | 10/1987 | Carter et al. . | |
| 4,717,814 | 1/1988 | Krumme . | |
| 4,722,471 | 2/1988 | Gray et al. | 174/DIG. 8 X |
| 4,745,264 | 5/1988 | Carter . | |
| 4,752,673 | 6/1988 | Krumme . | |

FOREIGN PATENT DOCUMENTS 0241597 10/1987 European Pat. Off. .

*Primary Examiner*—Timothy V. Eley
*Assistant Examiner*—Carl J. Arbes
*Attorney, Agent, or Firm*—Anton P. Ness

[57] ABSTRACT

A plurality of terminals already disposed in a housing of an electrical connector, include solder tails extending rearwardly from the housing which have a thin layer of magnetic material deposited on an outer surface thereof, so that respective wire ends may be placed therealong with solder preforms within lengths of heat recoverable tubing may be placed therearound and a high frequency current induced in the magnetic layer which then generates thermal energy sufficient to melt the solder and shrink the tubing forming terminations between the wires and the terminals and simultaneously sealing the terminations. The magnetic material may be nickel-iron alloy clad to a brass solder tail layer. The thermal energy is generated in an amount necessary to raise the temperature of the magnetic layer to its Curie temperature for the given frequency used and maintain that temperature. Each terminal thus includes an integral self-regulating thermal energy source, and the thermal energy radiates outwardly from the solder tails and is thus localized at the termination sites. The heating necessary to melt the solder is thus controlled in temperature and in location, substantially unaffecting the remainder of the connector, in an energy efficient process.

5 Claims, 4 Drawing Sheets

METHOD OF TERMINATING WIRES TO TERMINALS

FIELD OF THE INVENTION

The present invention relates to the field of electrical connectors and more particularly to multiterminal connectors for terminating a plurality of conductor wires.

BACKGROUND OF THE INVENTION

Electrical connectors are known which have a plurality of terminals disposed in a dielectric housing and which are to be terminated to a respective plurality of conductor wires. In one such connector the terminals are disposed in a single row within a housing molded thereover and extend rearwardly from the housing, to conclude in termination sections comprising shallow channels termed solder tails. The housing may include cylindrical portions extending rearwardly to surround the terminals forwardly of the solder tails. When the conductor wires are prepared to be terminated to the solder tails, individual sleeve-like solder preforms encased within respective longer sleeves of heat recoverable or heat shrink tubing are placed over the rearwardly extending terminal portions so that the solder preforms surround the solder tails, or a strip of such units appropriately spaced apart; the stripped wire ends are then inserted into the heat recoverable tubing sleeves and into the solder preforms surrounding the solder tails; the entire assembly is then placed in a conventional thermal energy source and heated by convection, with the heat energy penetrating through the heat recoverable tubing to melt the solder which then flows around the stripped wire ends within the solder tails and upon cooling forms respective solder joints joining the conductor wires to the terminals; and simultaneously the heat recoverable tubing is heated above a threshold temperature at which the tubing shrinks in diameter until it lies adjacent and tightly against surfaces of the solder tails and the wire termination therewithin, a portion of the insulated conductor wire extending rearwardly therefrom, and a portion of the terminal extending forwardly therefrom to the rearward housing surface, sealing the exposed metal surfaces. Apparatus for wire and sleeve handling with respect to such a connector is known such as from U.S. Pat. No. 3,945,114. Within forward and rearward ends of the tubing are located short sleeve-like preforms of fusible sealant material which will shrink and also tackify upon heating to bond and seal to the insulation of the wire, and to the cylindrical housing portions therewithin and to bond to the surrounding heat recoverable tubing. Examples of such assemblies of heat recoverable tubing lengths with solder preforms and sealant preforms therein are disclosed in U.S. Pat. Nos. 3,525,799; 4,341,921 and 4,595,724.

Conventional thermal energy sources achieve a temperature in excess of a control temperature, which is chosen to be somewhat above the ideal temperature at which a particular solder material melts in order to compensate for less than ideal thermal energy transfer. Several disadvantages attend such a thermal energy delivery method: portions of the connector other than connection sites are subjected to substantial heat which may be detrimental to the connector material; the thermal energy applied to connector portions other than the connection sites is wasted; components possibly may be damaged because of general overheating, and some sites may achieve a temperature much higher than necessary in order to assure that other sites achieve a sufficient solder melting temperature; the thermal energy source either requires a long warm-up period which is wasteful of time, or remains heated at its steady state temperature which is wasteful of energy; and maintenance of a continuous and accurate control over temperature and time is an ideal desire requiring a diligence and responsive apparatus not consistently met or found in practice. Another disadvantage is that heat recoverable tubing which is initially made transparent and is desired to remain transparent to allow visual inspection of the solder joint after termination, commonly receives enough excess thermal energy to opaquify, at least obscuring the solder joint therewithin.

It is desired to obtain solder joints without heating all portions of the connector.

It is desired to consistently obtain assured solder joints in a multiterminal connector having prehoused terminals.

It is known in the prior art to utilize a self-regulating temperature source which when energized by a constant amplitude, high frequency alternating current passing therethrough, generates thermal energy and achieves a resulting constant temperature. Such a temperature can be selected to be just higher than the ideal temperature at which solder melts. The self-regulating temperature source is disclosed in U.S. Pat. Nos. 4,256,945; 4,623,401; 4,659,912; 4,695,713; 4,701,587; 4,717,814; 4,745,264 and European Patent Publication No. 0241,597, which are expressly incorporated herein by reference. The self-regulating temperature source employs a substrate of copper or copper alloy or other conductive material of low electrical. resistivity, negligible magnetic permeability and high thermal conductivity; deposited on one surface thereof is a thin layer of thermally conductive magnetic material such as iron, nickel or a nickel-iron alloy having a much higher electrical resistance and magnetic permeability than the substrate material.

When a radio frequency current for example is passed through such a two-layer structure, the current initially is concentrated in the thin magnetic material layer; when the temperature in the magnetic material layer reaches its Curie temperature, it is known that the magnetic permeability of the layer decreases dramatically; the current density profile then expands into the non-magnetic substrate of low resistivity and the substrate layer heats up. The thermal energy is then transmitted by conduction to adjacent structure such as wires and solder which act as thermal sinks; since the temperature at thermal sink locations does not rise to the magnetic material's Curie temperature as quickly as at non-sink locations, the current remains concentrated in those portions of the magnetic material layer adjacent the thermal sink locations and is distributed in the low resistance substrate at non-sink locations. It is known that for a given frequency the self-regulating temperature source achieves and maintains a certain maximum temperature dependent on the particular magnetic material and conductive materials and the given thicknesses thereof.

The conductive substrate can be copper having a magnetic permeability of about one and a resistivity of about 1.72 micro-ohms per centimeter. The magnetic material may be for example a clad coating of nickel-iron alloy such as Alloy No. 42 (forty-two percent nickel, fifty-eight percent iron) or Alloy No. 42-6 (forty-two percent nickel, fifty-two percent iron, six percent chromium). Typical magnetic permeabilities for the magnetic layer range from fifty to about one thousand, and electrical resistivities normally range from twenty to ninety micro-ohms per centimeter as compared to 1.72 for copper; the magnetic material layer can have a Curie temperature selected to be from the range of between 200° C. to 500° C. The thickness of the magnetic material layer is typically one skin depth; the skin depth is proportional to the square root of the resistivity of the magnetic material, and is inversely proportional to the square root of the product of the magnetic permeability of the magnetic material and the frequency of the alternating current passing through the two-layer structure.

SUMMARY OF THE INVENTION

The present invention employs self-regulating temperature source technology to terminate a plurality of conductor wires to respective terminals of an electrical connector. A terminal subassembly is formed by placing a plurality of terminals in a dielectric housing, such as by molding dielectric material around body sections of the terminals, and contact sections of the terminals are exposed along a mating face of the housing for eventual mating with corresponding contact sections of another connector. Termination sections of the terminals extend rearwardly from the housing to be terminated to individual conductor wires, and comprise preferably shallow channels. The terminals may be made of a copper alloy such as brass, phosphor bronze or beryllium copper for example. On the outwardly facing surface of the termination section is clad or plated thereto a thin layer of a magnetic material having high electrical resistance and high magnetic permeability; the presence of such a thin magnetic layer converts the termination section into an individual self-regulating temperature source integral with the terminal.

Preformed solder preforms are placed around the termination sections, with lengths of heat recoverable tubing around the solder preforms and extending forwardly over cylindrical housing flanges covering the terminals forwardly of the terminating sections, to the rear surface of the housing, and rearwardly a distance beyond the ends of the termination sections. Stripped ends of conductor wires are placed along the respective channels and within the solder preforms, and a portion of the insulated wire extends into the rearward end of the heat recoverable tubing lengths. Preforms of sealant material may be disposed within the forward and rearward tubing sections to shrink, tackify and bond to the housing flanges and wire insulation respectively, and bond to the surrounding portions of heat recoverable tubing.

The assembly is then placed within appropriate tooling having an inductance coil surrounding the plurality of termination sections and transverse to the assembly, and the coil is energized to produce a selected constant amplitude high frequency alternating current. The current induces corresponding currents in the plurality of termination sections producing local thermal energy which rises to a certain temperature selected to be slightly higher than needed to melt the solder preforms, thereby melting the solder which forms solder joints between the wires and the termination sections. The thermal energy also radiates outwardly and is transmitted to and begins to shrink and tackify the sealant preforms and to recoverable the surrounding heat shrink tubing which reduces to conform to the outer surfaces of the structure therewithin including the insulated wire portion, the termination sections including the terminations, the shrunken sealant preforms and the housing flanges. The terminations of the terminals to the wires are completed and the terminations and all exposed metal is sealed, completing the connector, which then may be placed within a metal shell for physical protection and shielding against electromagnetic interference.

It is an objective to provide a connector having a plurality of discrete terminals to be terminated to conductor wires and then sealed in a simple, assured, efficient and economical process.

It is another objective to solder the wires and seal the terminations simultaneously.

It is a further objective to solder the wires to the terminals by assuredly achieving a certain selected temperature at all termination sites.

It is yet another objective to provide the necessary elevated temperature at only the connection sites.

It is still another objective to provide the thermal energy from a source within the solder preform, with the energy then radiating outwardly to sealant preforms and transparent tubing therearound after the solder melts, thus minimizing the amount of excess heat received by the tubing, enhancing its ability to remain transparent, and thereby allow visual inspection of the solder joint.

An example of the present invention will now be described with reference to the accompanying drawings.

DETAILED DESCRIPTION OF THE PREFERRED EMBODIMENT

Figure 1:
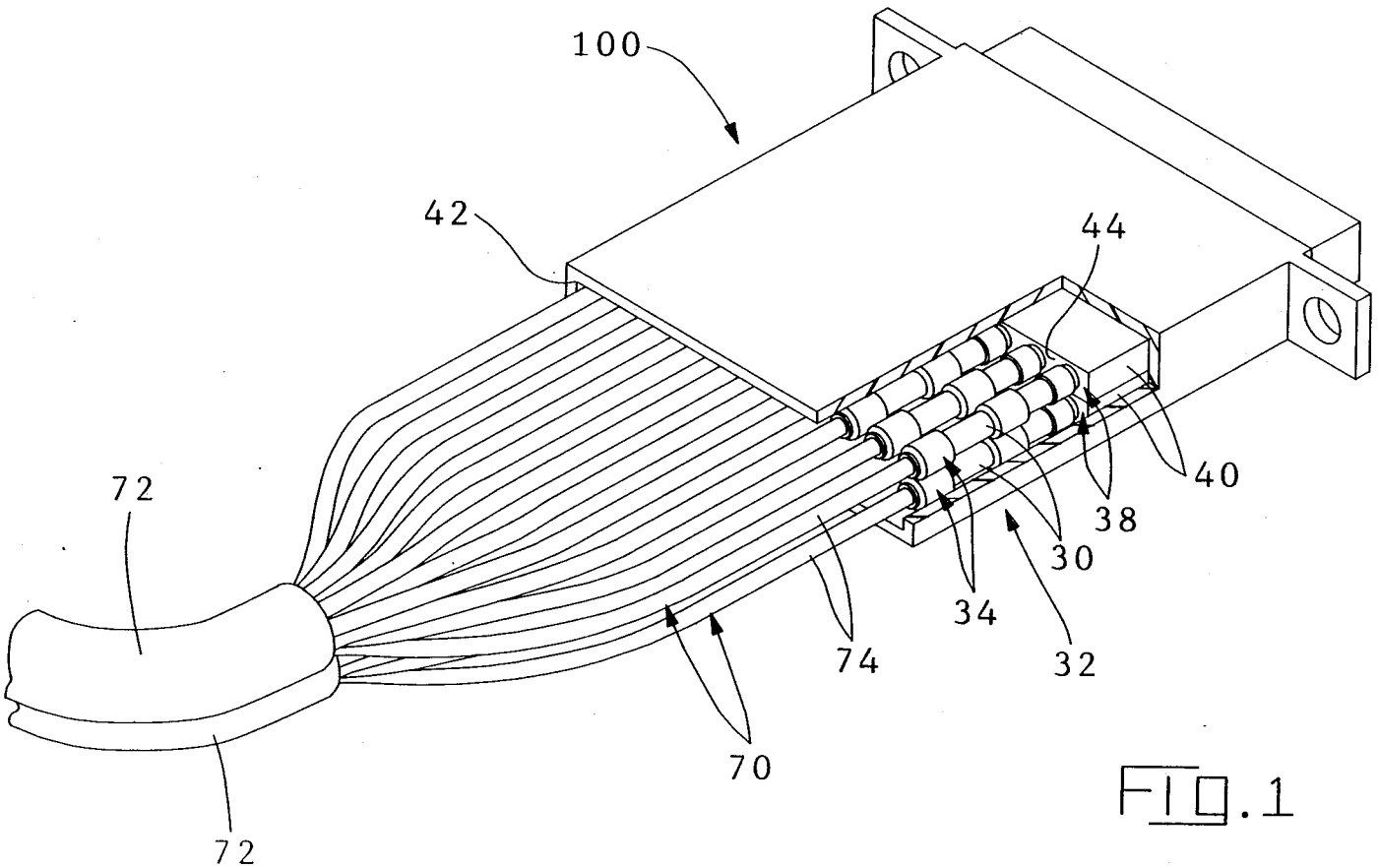
FIG. 1 is a perspective view of a connector with which the present invention is used;.

FIG. 1 shows a connector 100 having a plurality of terminals 10 (FIG. 2) secured within a pair of dielectric housings 40 within a shell 42 and terminated at terminations 30 to a respective plurality of conductor wires 70 within a termination region 32 rearwardly of wire face 44 of housings 40. Respective blade contact sections 12 (FIG. 2) of terminals 10 extend forwardly from a mating face 46 of housings 40 to be mated eventually with corresponding contact sections of terminals of a mating connector (not shown). Conductor wires 70 have insulation material therearound and may be bundled within an outer jacket 72. The termination region 32 includes individual seals 34 formed around terminations 30 and extending from wire face 44 of each housing 40 to insulated end portions 74 of wires 70. The terminals 10 are shown disposed in single rows for a low profile module 38 for a miniature rectangular connector, although the present invention may be used with other styles of connectors and other terminal arrangements. Terminals may also be socket or receptacle-type terminals.

Figure 2:
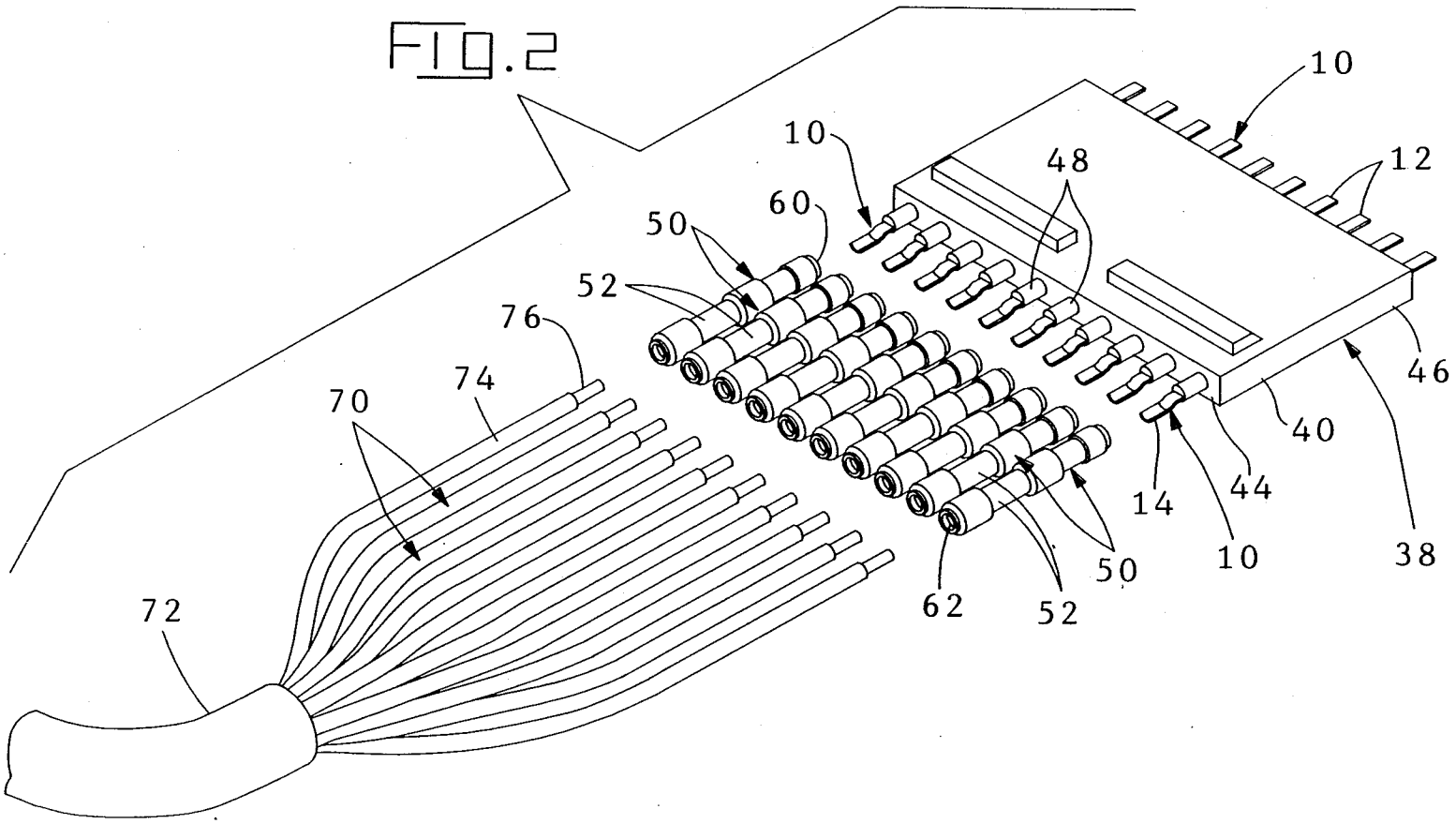
FIG. 2 is similar to FIG. 1 with a terminal subassembly of the connector exploded from the conductor wires, showing lengths of heat recoverable tubing containing solder preform used in the assembly of the connector.
Figures 3, 4:
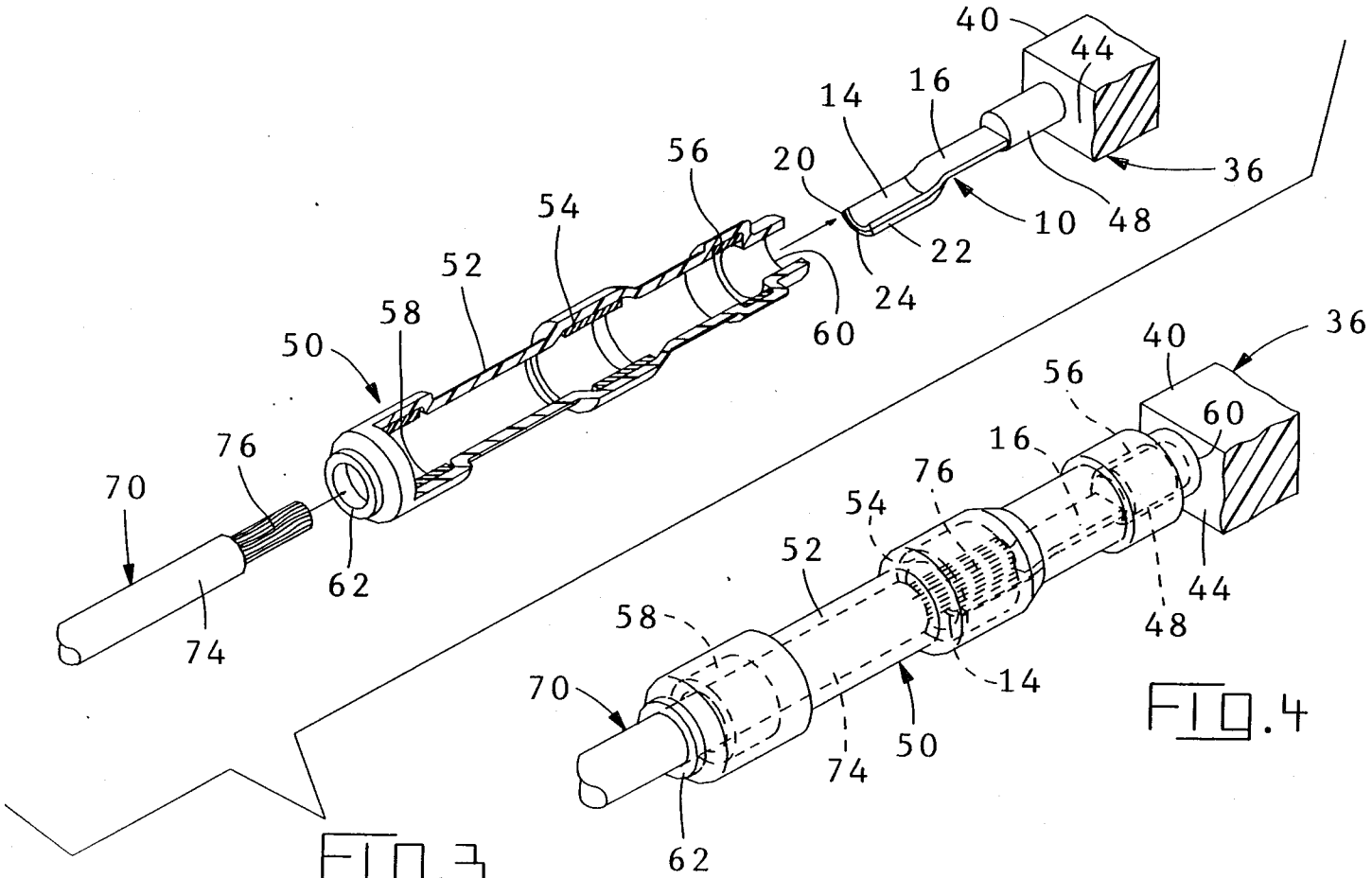
FIGS. 3 to 5 are enlarged perspective views of a single termination site showing a termination section, solder preform, tubing length and wire end prior to termination, in place to be terminated, and terminated and sealed respectively.

Referring to FIGS. 2 and 3, each terminal 10 includes a terminating section 14 disposed at the end of an intermediate section 16 extending rearwardly from a body section secured within housing 40. Preferably intermediate section 16 is embedded within a cylindrical housing portion or flange 48 extending rearwardly from wire face 44 to facilitate eventual process steps and to assure appropriate sealing. Terminating section 14 has a shallow channel shape and is conventionally termed a solder tail for eventual placement of a stripped end portion 76 of a conductor wire 70. Sleeve assembly 50 associated with solder tail 14 comprises a length of heat recoverable tubing 52, which includes therewithin a solder preform 54 and preferably includes two sealant preforms 56,58 also therewithin.

Solder preform 54 preferably is formed in a sleeve shape of short length large enough to be placed over and around a respective solder tail 14. Length 52 of preferably transparent heat shrink tubing is formed to be placed over solder preform 54 and be sufficiently long to extend over flange 48 from wire face 44, over solder tail 14, and over insulated wire end portion 76. Solder preform 54 is placed within tubing 52 at an axial location appropriate so that when the sleeve assemblies 50 are placed over the rearwardly extending terminal portions the solder preform 54 will surround the solder tail 14. Sealant preforms 56,58 are short sleeves axially spaced to be disposed over the end of flange 48 and the insulated wire end portion 76. The plurality of sleeve assemblies 50 for the plurality of solder tails 14 may be joined if desired by a strip of adhesive tape or the like to form a single entity for convenient handling as is conventionally known, with sleeve assemblies 50 appropriately spaced apart to correspond to the spacing of the terminals 10 secured in housing 40.

Solder preform 54 and sealant preforms 56,58 are secured within tubing 52 such as by being force-fit therewithin, or by tubing 52 being partially shrunk or reduced in diameter therearound. Solder preform 54 may be made of tin-lead solder including solder flux therein, such as for example Sn 63 RMA meltable at a temperature of about 183° C. or SB-5 meltable at about 240° C.; sealant preforms 56,58 may comprise for example a homogeneous mixture of polyvinylidene fluoride, methacrylate polymer and antimony oxide and shrink in diameter at a nominal temperature selected to be about 190° C.; and tubing 52 is preferably transparent and may be of cross-link polyvinylidene fluoride and have a nominal shrinking temperature of about 175° C. Generally it would be preferable to select a solder tail to achieve a temperature of about 50° C. to 75° C. above the solder melting point.

Figures 5, 6:
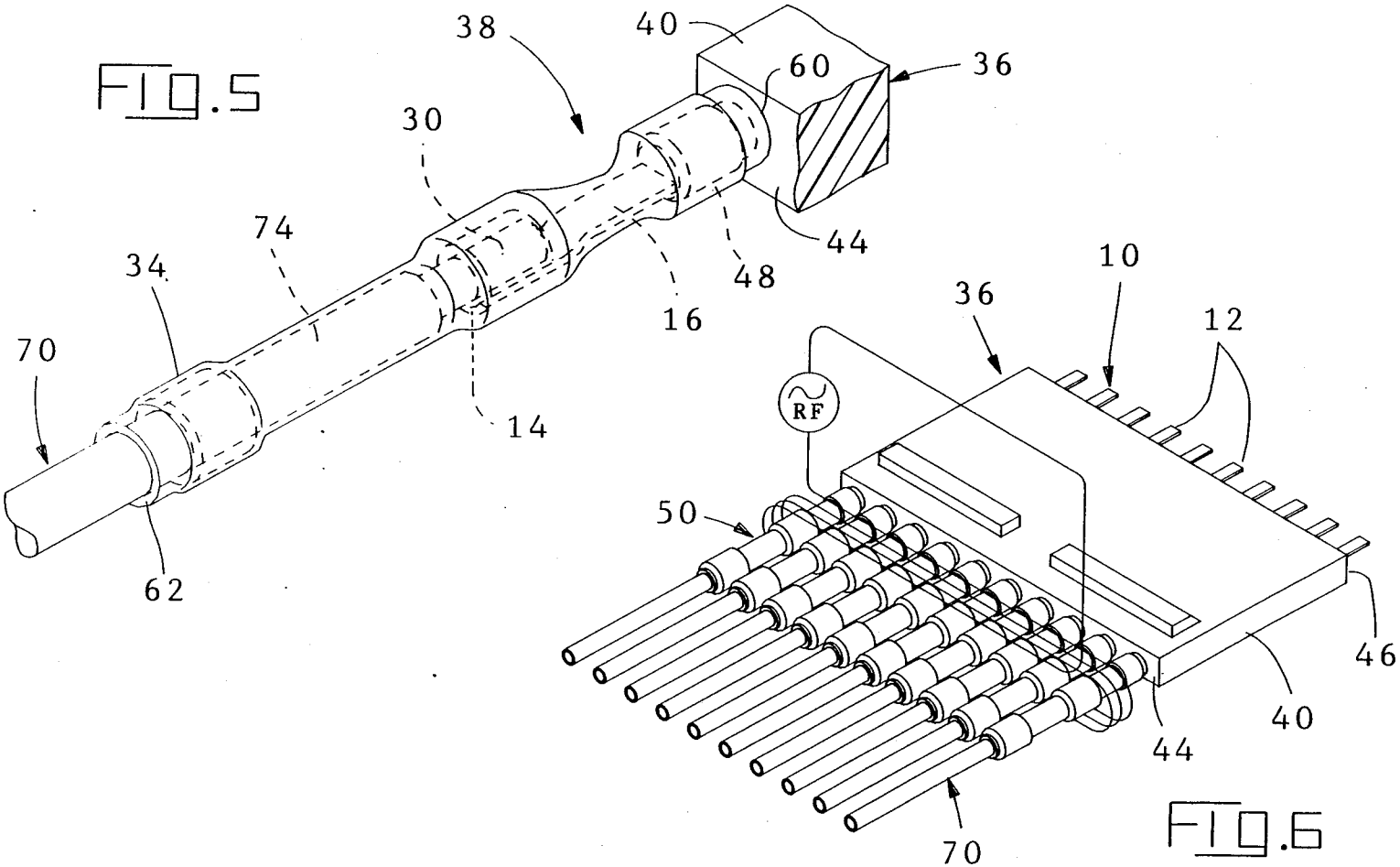
FIG. 6 is a diagrammatic view showing the terminal subassembly and wires being terminated by a high frequency current generator.

FIGS. 3 to 5 illustrate the present invention, in which a stripped wire end 76 is terminated to a respective solder tail 14 of a terminal 10, forming a termination 30 and sealed therearound by seal 34. Terminal 10 can be made from a strip of stock metal such as brass or phosphor bronze or beryllium copper, for example, and the portion to become solder tail 14 includes a layer 20 of that metal having a thickness of for example 0.020 inches. The strip of stock metal may then be nickel plated. The surface to become outer or lower surface 22 of layer 20 of solder tail 14 has deposited thereon a thin layer 24 of magnetic material such as a nickel-iron alloy. Typically a roll cladding process may be used where an amount of the magnetic material is laid over the substrate, then subjected to high pressure and temperature which diffuses the two materials to get at the boundary layer, but other processes such as plating or sputter depositing could be used. The portion of the strip to become solder tails 14 is then optionally plated with tin/lead metal for an enhanced solder-receptive surface, and the portion to become contact sections 12 may then be gold plated. Individual terminals 10 may then be stamped and formed. A thin layer of dielectric coating material may be applied over the magnetic material to inhibit oxidation. It is believed that stamping and forming steps work harden the magnetic material layer which may lower its magnetic permeability. Optionally a layer of nickel could be plated onto the outer surface 22 of the already stamped and formed terminal 10 to a thickness preferably 1½ to 2 times the skin depth. A similar terminating section for a terminal useful in surface mounting to a printed circuit conductive pad is disclosed in U. S. patent application Ser. No. 277,361 filed Nov. 29, 1988 and assigned to the assignee hereof.

An example of a process using the terminal-integral self-regulating temperature source of the present invention would be: providing an apparatus capable of providing a constant amplitude high frequency alternating current having frequency such as 13.56 MHz; selecting a solder preform having tin-lead solder with flux which melts at a nominal temperature of about 183° C.; selecting heat recoverable tubing shrinkable at a nominal temperature of 175° C. and disposed around the solder sleeve; forming the solder tail having a layer of brass with a thickness of 0.020 inches and having thereunder a thin clad layer of Alloy No. 42-6 having a thickness of 0.002 inches and applying an RF current at 13.56 MHz thereto for 30 seconds. The integral self-regulating temperature source which comprises the solder tail will rise to a temperature of generally about 250° C., melt the solder, shrink and tackify the sealant preforms, and shrink the tubing. Also, if solder preforms are selected having a melting temperature of about 240° C. such as SB-5, a magnetic material may be used having a nominal Curie temperature of about 300° C. to 315° C.

As shown in FIG. 4, sleeve assembly 50 is placed over a respective solder tail 14 until leading end 60 abuts wire face 44 of housing 40, so that sealant preform 56 surrounds flange 48 and solder preform 54 surrounds solder tail 14. Stripped conductor wire 76 is inserted into trailing end 62 of sleeve assembly 50 until located such as by visual observation through transparent tubing 52 completely along solder tail 14 within solder preform 54 and insulated end portion 74 is disposed within sealant preform 58. FIG. 5 shows a terminated and sealed connection after the solder has been melted according to the present invention by high frequency induction heating to form a solder joint termination 30 between wire end 78 and solder tail 14, sealant preforms 56,58 have been shrunk in diameter to bond to flange 48 and insulated wire end 74, and tubing 52 has shrunk to conform to the outer surfaces of the structures therewithin, and bonds to sealant preforms 56,58 seals the termination by tightly gripping about the insulated wire end 74 at trailing end 62 and the flange 48 at leading end 60, forming a seal 34.

FIG. 6 illustrates the method of terminating the wire and solder tail and sealing the termination. The terminal subassembly and inserted wires are placed and clamped within an apparatus containing an inductance coil closely surrounding the terminating region 32. Such an apparatus is disclosed in U.S. Pat. No. 4,626,767. A constant amplitude high frequency alternating current is generated such as a radio frequency signal at a frequency of 13.56 MHz. After a length of time such as about 30 seconds, the terminal-integral self-regulating temperature sources defined by the clad solder tails 14 of the respective terminals 10 have achieved a certain temperature determined by the particular solder tail magnetic material. In FIG. 5 the solder of solder preforms 54 has melted and joined wire end 76 to solder 14 forming termination 30, the sealant preforms 56,58 have shrunk and tackified, and the tubing lengths 52 have shrunk to grip flanges 48 and insulated wire ends 74 and conform to the surfaces of the terminations 30 therewithin, and bonding to sealant preforms 56,58 forming seals 34.

An alternate method of generating current could be utilized with the terminals of the present invention, by forming ohmic connections with the terminal contact section 12 to transmit high frequency current through the terminals, with the other ends of wires 70 forming the other ohmic connections so long as wire ends 76 engage the solder tails.

Other variations may be made by skilled artisans to the present invention which are within the spirit of the invention and the scope of the claims.

What is claimed is:

1. A method of terminating wires to terminals and simultaneously sealing the terminations, comprising the steps of:

identifying an apparatus being capable of generating a constant amplitude high frequency alternating current of known frequency;

selecting at least one terminal disposed in housing means, each said at least one terminal including a portion extending rearwardly from said housing means to a wire-receiving section at a wire-receiving end, at least each said wire-receiving section comprising first layer of a first metal having low electrical resistance and minimal magnetic permeability and deposited on an outwardly facing surface thereof a second layer of a second metal having high electrical resistance and high magnetic permeability, said second layer having a thickness approximately equal to one skin depth of said second metal, given said known frequency;

selecting solder material having a nominal melting temperature slightly less than the Curie temperature of said second metal and selecting heat recoverable tubing having a nominal shrinking temperature slightly less than the Curie temperature of said second metal;

positioning a stripped wire end of a conductor wire associated with each said at least one terminal along an inwardly facing surface of said wire-receiving section of each said at least one terminal;

placing a preform of said solder material at least adjacent each said stripped wire end along a respective said wire-receiving section and placing a length of said heat recoverable tubing of sufficient diameter around each said solder preform and said respective wire-receiving section and extending forwardly along at least a portion of said associated terminal to a forward tubing end and rearwardly along said stripped wire end to an insulated portion of said wire to a rearward tubing end, defining a pretermination assembly;

placing said pretermination assembly within said apparatus; and generating said constant amplitude high frequency alternating current in said apparatus for a selected length of time, whereby a corresponding current is generated in each said wire-receiving section and sufficient thermal energy is generated by each said wire-receiving section to achieve and maintain the Curie temperature of said second layers, the thermal energy being transmitted radially outwardly to said solder preforms adjacent said stripped wire ends and said wire-receiving sections melting said solder preforms and forming assured terminations of said stripped wire ends to said wire-receiving sections, and the thermal energy being further transmitted radially outwardly and axially from said terminations to said lengths of heat recoverable tubing radially shrinking said tubing lengths to conform to the outwardly facing surfaces of said wires and said terminal portions therewithin and tightly engaging the insulated wires extending rearwardly therefrom and the terminal portions extending forwardly therefrom, sealing the terminations.

2. A method as set forth in claim 1 wherein said apparatus includes an inductance coil within which said pretermination assembly is capable of being placed with said inductance coil at least radially surrounding said wire-receiving section within said heat recoverable tubing.

3. A method as set forth in claim 1 wherein said second layer has a thickness of between about 1.5 and 2 times its skin depth.

4. A method as set forth in claim 1 wherein each said length of heat recoverable tubing includes respective sealant preforms within said forward and rearward ends thereof comprising heat recoverable sleeves adapted to shrink and tackify at a temperature at least slightly less than said Curie temperature of said second metal, said sealant preforms located to surround respective said terminal portions forwardly of said wire-receiving sections and respective insulated portions of said wires, thereby bonding and assuredly sealing against said terminal portions and insulated wire portions therewithin and said tubing forward and rearward ends upon shrinking and tackifying caused by said thermal energy.

5. A method as set forth in said claim 1 wherein each said solder preform has a sleeve shape and is previously secured within a central portion of a respective said heat recoverable tubing length.

* * * * *